US011304021B2

(12) United States Patent
Beran

(10) Patent No.: US 11,304,021 B2
(45) Date of Patent: Apr. 12, 2022

(54) DEFERRED AUDIO RENDERING

(71) Applicant: Sony Interactive Entertainment Inc., Tokyo (JP)

(72) Inventor: Erik Beran, Belmont, CA (US)

(73) Assignee: SONY INTERACTIVE ENTERTAINMENT INC., Tokyo (JP)

( * ) Notice: Subject to any disclaimer, the term of this patent is extended or adjusted under 35 U.S.C. 154(b) by 0 days.

(21) Appl. No.: 16/697,832

(22) Filed: Nov. 27, 2019

(65) Prior Publication Data

US 2020/0178016 A1 Jun. 4, 2020

Related U.S. Application Data

(60) Provisional application No. 62/773,035, filed on Nov. 29, 2018.

(51) Int. Cl.

| | |
|---|---|
| ***H04S 7/00*** | (2006.01) |
| ***H04R 5/02*** | (2006.01) |
| ***H04R 5/04*** | (2006.01) |
| ***H04S 3/00*** | (2006.01) |

(52) U.S. Cl.

CPC ..... *H04S 7/303* (2013.01); *H04R 5/02* (2013.01); *H04R 5/04* (2013.01); *H04S 3/008* (2013.01); *H04S 2400/01* (2013.01); *H04S 2400/11* (2013.01); *H04S 2420/01* (2013.01); *H04S 2420/11* (2013.01)

(58) Field of Classification Search

None

See application file for complete search history.

(56) References Cited

U.S. PATENT DOCUMENTS

| | | | | |
|---|---|---|---|---|
| 5,757,927 | A | 5/1998 | Gerzon et al. | |
| 2011/0040396 | A1* | 2/2011 | Kraemer ..... | H04R 3/12 700/94 |
| 2012/0213375 | A1 | 8/2012 | Mahabub et al. | |

(Continued)

FOREIGN PATENT DOCUMENTS

| | | | |
|---|---|---|---|
| WO | 2017125821 | A1 | 7/2017 |
| WO | 2018026963 | A1 | 2/2018 |
| WO | 2018060550 | A1 | 4/2018 |

OTHER PUBLICATIONS

J. Driscoll and D. Healy, "Computing Fourier Transforms and Convolutions on the 2-Sphere," Adv. Appl. Math., vol. 15, No. 2, pp. 202-250, Jun. 1994.

(Continued)

*Primary Examiner* — Qin Zhu

(74) *Attorney, Agent, or Firm* — JDI Patent; Joshua Isenberg; Robert Pullman

(57) ABSTRACT

An audio rendering method and computer readable medium instructions, comprising obtaining sound object data for a sound object in a first format suitable for rendering into an output signal and obtaining user tracking information for a user at a time subsequent to setting up the sound object data in the first format. The sound object is rendered by converting the sound object data from the first format into the output signal and in conjunction with said rendering a transform is applied to the sound object, wherein the transform depends on the user tracking data. Two or more speakers are driven using the output signal.

22 Claims, 5 Drawing Sheets

(56) References Cited

U.S. PATENT DOCUMENTS

| | | | | |
|---|---|---|---|---|
| 2013/0041648 | A1* | 2/2013 | Osman | H04S 7/302 704/2 |
| 2014/0270245 | A1 | 9/2014 | Elko et al. | |
| 2014/0355794 | A1 | 12/2014 | Morrell et al. | |
| 2015/0170657 | A1 | 6/2015 | Thompson et al. | |
| 2016/0302005 | A1 | 10/2016 | Fedosov et al. | |
| 2017/0366912 | A1* | 12/2017 | Stein | H04S 7/304 |
| 2018/0091919 | A1* | 3/2018 | Chon | H04S 3/008 |
| 2018/0143799 | A1* | 5/2018 | Kuch | H04S 7/30 |
| 2018/0196123 | A1* | 7/2018 | Mate | G01S 5/06 |
| 2018/0210695 | A1* | 7/2018 | Tsingos | H04S 7/306 |
| 2018/0262856 | A1* | 9/2018 | Wang | H04S 7/308 |
| 2018/0288553 | A1* | 10/2018 | Lee | H04N 21/84 |
| 2018/0315437 | A1* | 11/2018 | Edry | G10L 19/24 |
| 2018/0359592 | A1* | 12/2018 | Laaksonen | H04S 3/008 |
| 2019/0289418 | A1* | 9/2019 | Jang | H04S 7/303 |
| 2019/0313200 | A1* | 10/2019 | Stein | G06F 3/04845 |
| 2020/0382747 | A1* | 12/2020 | Prins | G06F 3/012 |
| 2021/0006929 | A1* | 1/2021 | Laaksonen | H04S 7/303 |
| 2021/0044913 | A1* | 2/2021 | Haussler | G06F 3/012 |

OTHER PUBLICATIONS

Matthias Kronlachner, Master's Thesis: "Spatial Transformations for the Alteration of Ambisonic Recordings", Institute of Electronic Music and Acoustics University of Music and Performing Arts, Graz Graz University of Technology, Graz, Austria, Jun. 2014.

Zotter Franz, "Sampling Strategies for Acoustic Holography/Holophony on the Sphere," in NAG-DAGA, 2009.

Zotter, Franz , "Analysis and Synthesis of Sound-Radiation with Spherical Arrays", PhD dissertation, University of Music and Performing Arts, Graz, Austria, 2009.

* cited by examiner

DEFERRED AUDIO RENDERING

CLAIM OF PRIORITY

This application claims the priority benefit of U.S. Provisional Patent Application No. 62/773,035, filed Nov. 29, 2018, the entire contents of which are incorporated herein by reference.

FIELD

The present disclosure relates to audio signal processing and rendering of sound objects. In particular, aspects of the present disclosure relate to deferred rendering of sound objects.

BACKGROUND

Human beings are capable of recognizing the source location, i.e., distance and direction, of sounds heard through the ears through a variety of auditory cues related to head and ear geometry, as well as the way sounds are processed in the brain. Surround sound systems attempt to enrich the audio experience for listeners by outputting sounds from various locations which surround the listener.

Typical surround sound systems utilize an audio signal having multiple discrete channels that are routed to a plurality of speakers, which may be arranged in a variety of known formats. For example, 5.1 surround sound utilizes five full range channels and one low frequency effects (LFE) channel (indicated by the numerals before and after the decimal point, respectively). For 5.1 surround sound, the speakers corresponding to the five full range channels would then typically be arranged in a room with three of the full range channels arranged in front of the listener (in left, center, and right positions) and with the remaining two full range channels arranged behind the listener (in left and right positions). The LFE channel is typically output to one or more subwoofers (or sometimes routed to one or more of the other loudspeakers capable of handling the low frequency signal instead of dedicated subwoofers). A variety of other surround sound formats exists, such as 6.1, 7.1, 10.2, and the like, all of which generally rely on the output of multiple discrete audio channels to a plurality of speakers arranged in a spread out configuration. The multiple discrete audio channels may be coded into the source signal with one-to-one mapping to output channels (e.g. speakers), or the channels may be extracted from a source signal having fewer channels, such as a stereo signal with two discrete channels, using other techniques like matrix decoding to extract the channels of the signal to be played.

The location of a source of sound can be simulated by manipulating the underlying source signal using a technique referred to as "sound localization." Some known audio signal processing techniques use what is known as a Head Related Impulse Response (HRIR) function or Head Related Transfer Function (HRTF) to account for the effect of the user's own head on the sound that reaches the user's ears. An HRTF is generally a Fourier transform of a corresponding time domain Head Related Impulse Response (HRIR) and characterizes how sound from a particular location that is received by a listener is modified by the anatomy of the human head before it enters the ear canal. Sound localization typically involves convolving the source signal with an HRTF for each ear for the desired source location. The HRTF may be derived from a binaural recording of a simulated impulse in an anechoic chamber at a desired location relative to an actual or dummy human head, using microphones placed inside of each ear canal of the head, to obtain a recording of how an impulse originating from that location is affected by the head anatomy before it reaches the transducing components of the ear canal.

A second approach to sound localization is to use a spherical harmonic representation of the sound wave to simulate the sound field of the entire room. The spherical harmonic representation of a sound wave characterizes the orthogonal nature of sound pressure on the surface of a sphere originating from a sound source and projecting outward. The spherical harmonic representation allows for a more accurate rendering of large sound sources as there is more definition to the sound pressure of the spherical wave.

For virtual surround sound systems involving headphone playback, the acoustic effect of the environment also needs to be taken into account to create a surround sound signal that sounds as if it were naturally being played in some environment, as opposed to being played directly at the ears or in an anechoic chamber with no environmental reflections and reverberations. One particular effect of the environment that needs to be taken into account is the location and orientation of the listener's head with respect to the environment since this can affect the HRTF. Systems have been proposed that track the location and orientation of the user's head in real time and take this information into account when doing sound source localization for headphone-based systems.

It is within this context that aspects of the present disclosure arise.

BRIEF DESCRIPTION OF THE DRAWINGS

The teachings of the present disclosure can be readily understood by considering the following detailed description in conjunction with the accompanying drawings, in which.

DETAILED DESCRIPTION

Figure 1:
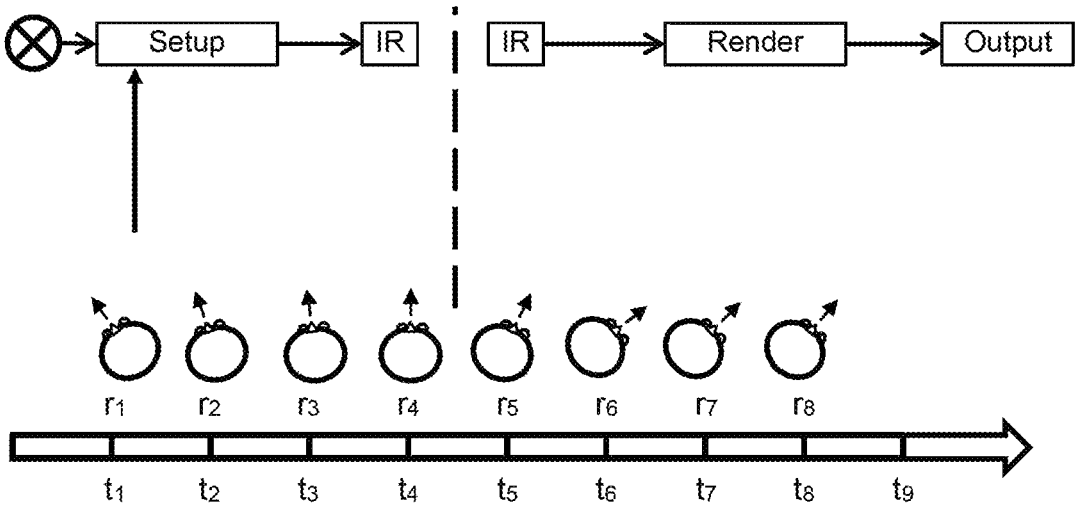
FIG. 1 (prior art)
FIG. 1 is a schematic diagram illustrating conventional audio rendering.

Although the following detailed description contains many specific details for the purposes of illustration, anyone of ordinary skill in the art will appreciate that many variations and alterations to the following details are within the scope of the invention. Accordingly, the exemplary embodiments of the invention described below are set forth without any loss of generality to, and without imposing limitations upon, the claimed invention.

Introduction

Aspects of the present disclosure relate to localization of sound in a sound system. Typically, in a sound system each speaker is connected to a main controller, sometimes referred to as an amplifier but may also take the form of a computer or game console. Each speaker unit in the sound system has a defined data path used to identify the individual unit, called a channel. In most modern speaker systems the overall amplitude or volume of each channel is controllable with the main controller. Additionally each speaker unit may also comprise several individual speakers that have different frequency response characteristics. For example a typical speaker unit comprises both a high range speaker, sometimes referred to as a tweeter and a mid-ranged speaker. These individual speakers typically cannot have their volume controlled individually thus for ease of discussion speaker hereafter will refer to a speaker unit meaning the smallest amount of speakers that can be have its volume controlled.

Sound Localization Through Application of Transfer Functions

One way to create localized sound is through a binaural recording of the sound at some known location and orientation with respect to the sound source. High quality binaural recordings may be created with dummy head recorder devices made of materials which simulate the density, size and average inter-aural distance of the human head. In creation of these recordings, information such as inter-aural time delay and frequency dampening due to the head is captured within the recording.

Techniques have been developed that allow any audio signal to be localized without the need to produce a binaural recording for each sound. These techniques take a source sound signal which is in the amplitude over time domain and apply a transform to the source sound signal to place the signal in the frequency amplitude domain. The transform may be a Fast Fourier transform (FFT), Discrete Cosine Transform (DCT) and the like. Once transformed the source sound signal can be convolved with a Head Related Transfer Function (HRTF) through point multiplication at each frequency bin.

The HRTF is a transformed version of the Head Related Impulse Response (HRIR) which captures the changes in sound emitted at a certain distance and angle as it passes between the ears of the listener. Thus the HRTF may be used to create a binaural version of a sound signal located at a certain distance from the listener. An HRIR is created by making a localized sound recording in an anechoic chamber similar to as discussed above. In general a broadband sound may be used for HRIR recording. Several recordings may be taken representing different simulated distances and angles of the sound source in relation to the listener. The localized recording is then transformed and the base signal is deconvolved with division at each frequency bin to generate the HRTF.

Additionally the source sound signal may be convolved with a Room Transfer Function (RTF) through point multiplication at each frequency bin. The RTF is the transformed version of the Room Impulse Response (RIR). The RIR captures the reverberations and secondary waves caused by reflections of source sound wave within a room. The RIR may be used to create a more realistic sound and provide the listener with context for the sound. For example and without limitation an RIR may be used that simulates the reverberations of sounds within a concert hall or within a cave. The signal generated by transformation and convolution of the source sound signal with an HRTF followed by inverse transformation may be referred to herein as a point sound source simulation.

The point source simulation recreates sounds as if they were a point source at some angle from the user. Larger sound sources are not easily reproducible with this model as the model lacks the ability to faithfully reproduce differences in sound pressure along the surface of the sound wave. Sound pressure differences which exist on the surface of a traveling sound wave are recognizable to the listener when a sound source is large and relatively close to the listener.

Sound Localization Through Spherical Harmonics

One approach to simulating sound pressure differences on the surface of a spherical sound wave is Ambisonics. Ambisonics as discussed above, models the sound coming from a speaker as time varying data on the surface of a sphere. A sound signal $f(t)$ arriving from location $\theta$.

$$\theta = \begin{pmatrix} \theta_x \\ \theta_y \\ \theta_x \end{pmatrix} = \begin{pmatrix} \cos\varphi\cos\vartheta \\ \sin\varphi\cos\vartheta \\ \sin\varphi \end{pmatrix} \quad \text{(eq. 1)}$$

Where $\varphi$ is the azimuthal angle in the mathematic positive orientation and $\partial$ is the elevation of the spherical coordinates. This surround sound signal, $f(\varphi, \partial, t)$ may then be described in terms of spherical harmonics where each increasing N order of the harmonic provides a greater degree of spatial recognition. The Ambisonic representation of a sound source is produced by spherical expansion up to an Nth truncation order resulting in (eq. 2).

$$f(\varphi, \vartheta, t) = \sum_{n=0}^{N} \sum_{m=-n}^{n} Y_n^m(\varphi, \vartheta)\phi_{nm}(t) \quad \text{(eq. 2)}$$

Where $Y^m_n$ represents spherical harmonic matrix of order n and degree m and $\phi_{mn}(t)$ are the expansion coefficients. Spherical harmonics are composed of a normalization term $N_n^{|m|}$, the legendre function $P_n^{|m|}$ and a trigonometric function.

$$Y_n^m(\varphi, \vartheta) = N_n^{|m|} P_n^{|m|}(\sin(\vartheta)) \begin{cases} \sin|m|\vartheta, \text{ for } m < 0 \\ \cos|m|\vartheta, \text{ for } m \geq 0 \end{cases} \quad \text{(eq. 3)}$$

Where individual terms can be of $Y_n^m$ can be computed through a recurrence relation as described in Zotter, Franz, "Analysis and Synthesis of Sound-Radiation with Spherical Arrays," Ph.D. dissertation, University of Music and Performing Arts, Graz, 2009 which is incorporated herein by reference.

Conventional Ambisonic sound systems require a specific definition for expansion coefficients $\phi_{nm}(t)$ and Normalization terms $N_n^{|m|}$. One traditional normalization method is through the use of a standard channel numbering system such as the Ambisonic Channel Numbering (ACN).

ACN provides for fully normalized spherical harmonics and defines a sequence of spherical harmonics as $ACN=n^2+n+m$ where n is the order of the harmonic and m, is the degree of the harmonic. The normalization term for ACN is (eq. 4)

$$N_n^{|m|} = \sqrt{\frac{(2n+1)(2-\delta_m)(n-|m|)!}{4\pi(n-|m|)!}} \quad \text{(eq. 4)}$$

ACN is one method of normalizing spherical harmonics and it should be noted that this is provided by way of example and not by way of limitation. There exist other ways of normalizing spherical harmonics which have other advantages. One example, provided without limitation, of an alternative normalization technique is Schmidt semi-normalization.

Manipulation may be carried out on the band limited function on a unit sphere $f(\theta)$ by decomposition of the function in to the spherical spectrum, $\phi_N$ using a spherical harmonic transform which is described in greater detail in J. Driscoll and D. Healy, "Computing Fourier Transforms and Convolutions on the 2-Sphere," *Adv. Appl. Math.*, vol. 15, no. 2, pp. 202-250, June 1994 which is incorporated herein by reference.

$$\mathrm{SHT}\{f(\theta)\}=\phi_N=\int_{S^2} y_N(\theta) f(\theta) d\theta \quad \text{(eq. 5)}$$

Similar to a Fourier transform the spherical harmonic transform results in a continuous function which is difficult to calculate. Thus to numerically calculate the transform a Discrete Spherical Harmonic Transform is applied (DSHT). The DSHT calculates the spherical transform over a discrete number of direction $\Theta=[\theta_1, \ldots \theta^L]^T$ Thus the DSHT definition result is;

$$\mathrm{DSHT}\{f(\Theta)\}=\phi_N=Y_N^{\dagger}(\Theta) f(\Theta) \quad \text{(eq, 6)}$$

Where † represents the moore-penrose pseudo inverse $$Y^{\dagger}=(y^T Y)^{-1} Y^T \quad \text{(eq. 7)}$$

The Discrete Spherical harmonic vectors result in a new matrix $Y_N(\Theta)$ with dimensions $L*(N+1)^2$. The distribution of sampling sources for discrete spherical harmonic transform may be described using any knaown method. By way of example and not by way of limitation sampling methods used may be Hyperinterpolation, Gauss-Legendre, Equiangular sampling, Equiangular cylindric, spiral points, HEALPix, Spherical t-designs. Methods for sampling are described in greater detail in Zotter Franz, "Sampling Strategies for Acoustic Holography/Holophony on the Sphere," in *NAGDAGA,* 2009 which is incorporated herein by reference. Information about spherical t-design sampling and spherical harmonic manipulation can be found in Kronlachner Matthias "Spatial Transformations for the Alteration of Ambisonic Recordings" Master Thesis, June 2014, Available at http://www.matthiaskronlachner.com/wp-content/uploads/2013/01/Kronlachner Master_Spatial_Transformations Mobile.pdf.

Movement of Sound Sources

The perceived location and distance of sound sources in an Ambisonic system may be changed by weighting the source signal with direction dependent gain $g(\theta)$ and the application of an angular transformation $\mathcal{T}\{\theta\}$ to the source signal direction $\theta$. After inversion of the angular transformation the resulting source signal equation with the modified location $f'(\theta, t)$ is;

$$f'(\theta,t)=g(\mathcal{T}^{-1}\{\theta\}) f(\mathcal{T}^{-1}\{\theta\},t) \quad \text{(eq. 8)}$$

The Ambisonic representation of this source signal is related by inserting $f(\theta, t)=y_N^T(\theta)\ \phi_N(t)$ resulting in the equation;

$$y_N^T(\theta)\phi_N'(t)=g(\mathcal{T}^{-1}\{\theta\}) y_N^T(\theta\mathcal{T}^{-1}\{\theta\})\phi_N(t) \quad \text{(eq. 9)}$$

The transformed Ambisonic signal $\phi_N'(t)$ is produced by removing $y_N^T(\theta)$ using orthogonality after integration over two spherical harmonics and application of discrete spherical harmonic transform (DSHT). Producing the equation;

$$\phi_N'(t)=T*\phi_N(t) \quad \text{(ea. 10)}$$

Where T represents the transformation matrix;

$$T=\mathrm{DHST}\{\mathrm{diag}\{g(\mathcal{T}^{-}\{\Theta\})\} y_N^T(\theta\mathcal{T}^{-1}\{\Theta\})\}=Y_N^{\dagger}(\Theta)\ \mathrm{diag}\{g(\mathcal{T}^{-1}\{\Theta\})\} y_N^T(\theta\mathcal{T}^{-1}\{\Theta\}) \quad \text{(eq. 11)}$$

Rotation of a sound source can be achieved by the application of a rotation matrix $T_r^{xyz}$ which is further described in Zoter "Sampling Strategies for Acoustic Holography/Holophony on the Sphere," and Kronlachner.

Sound sources in the Ambisonic sound system may further be modified through warping.

Generally a transformation matrix as described in Kronlachner may be applied to warp a signal in any particular direction. By way of example and not by way of limitation a bilinear transform may be applied to warp a spherical harmonic source. The bilinear transform elevates or lowers the equator of the source from 0 to arcsine $\alpha$ for any $\alpha$ between $-1<\alpha<1$. For higher order spherical harmonics the magnitude of signals must also be changed to compensate for the effect of playing the stretched source on additional speakers or the compressed source on fewer speakers. The enlargement of a sound source is described by the derivative of the angular transformation of the source ($\sigma$). The energy preservation after warping then may be provided using the gain fact $g(\mu')$ where;

$$g(\mu')=\frac{1}{\sqrt{\sigma}}=\frac{\sqrt{1-\alpha^2}}{1-\alpha\mu'} \quad \text{(eq. 12)}$$

Warping and compensation of a source distributes part of the energy to higher orders. Therefore the new warped spherical harmonics will require a different expansion order at higher decibel levels to avoid errors. As discussed earlier these higher order spherical harmonics capture the variations of sound pressure on the surface of the spherical sound wave.

Latency Issue

Conventional spatial audio associated with certain applications, such as video games, are subject to latency issues. FIG. 1A illustrates the nature of the problem. A system 100, such as a video game system, creates "sound objects" 101 that are characterized by characteristic sound data and a location in a virtual environment. The system 100 configures the sound object data 101 so that when the sound object data is rendered to an output signal 103 and used to drive a set of speakers (not shown), the sound a listener perceives the sound as originating from the designated location. When the speakers are part of a set of headphones the system must take the position and orientation of the listener's head into account before rendering the data to a signal. This is commonly done using some form of head tracking device 110 that provides the system 100 with position and rotation information $r_1, r_2 \ldots, r_8$ for the user's head at corresponding times $t_1, t_2, \ldots, t_8$. Conventionally, the system takes the tracking information $r_1$ into account when the system setting up the sound object 101 at time $t_1$. However, if there is significant latency between setting up the object and rendering the object the user's position and/or orientation may change and the user may perceive the sound may seem to be coming from the wrong direction as a result. For example, if the rendering 103 takes place at time $t_8$ the user's head position and/or orientation may be more accurately reflected by corresponding information $r_8$.

Deferred Audio Position Rendering to the User Device

Aspects of the present disclosure are directed to decreasing the perceived latency in such audio systems. Specifically in implementations according to aspects of the present disclosure, the virtual location of a sound object in a virtual environment is rendered locally on a user device from an intermediate format or audio objects and user tracking data, instead of being rendered at a console or host device. In some implementations, the user may have a set of headphones and a low latency head-tracker, the head tracker may be built into the headphones or separately coupled to the user's head. In another implementation, the motion-tracking controller may be used instead of a head tracker.

In either case, the deferred audio rendering system uses tracking information at the user to manipulate the sound signals to produce the final, orientation specific, output format which is played through the speakers and/or headphones of the user. For headphone-based HRTF-related audio, the virtual location of the sound object in the virtual environment relative to the orientation of the user can be simulated by applying a proper transform function and inter-aural delay as discussed above. For ambisonic-related audio, the proper ambisonic transform based on the user's orientation may be applied to the intermediate format audio signal as discussed above.

The tracking device may detect the user's orientation relative to a reference position. The tracking device may keep a table of the user's movements relative to the reference position. The relative movement may then be used to determine the user's orientation. The user's orientation may be used to select the proper transform and apply the proper transformations to rotate the audio to position match the user's orientation.

Figure 2A:
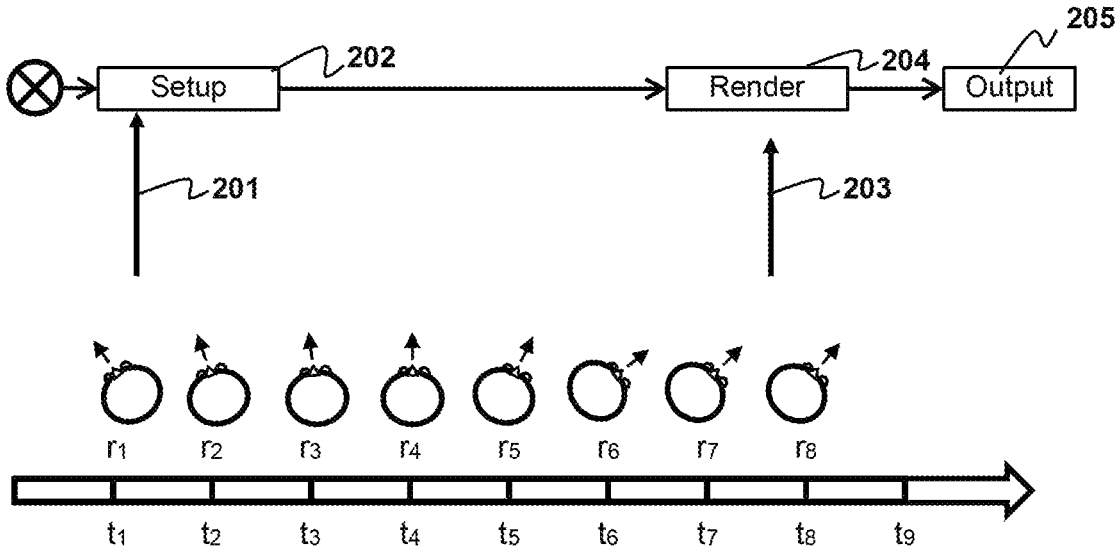
FIG. 2A is a schematic diagram illustrating an example of audio rendering according to aspects of the present disclosure.
Figure 2B:
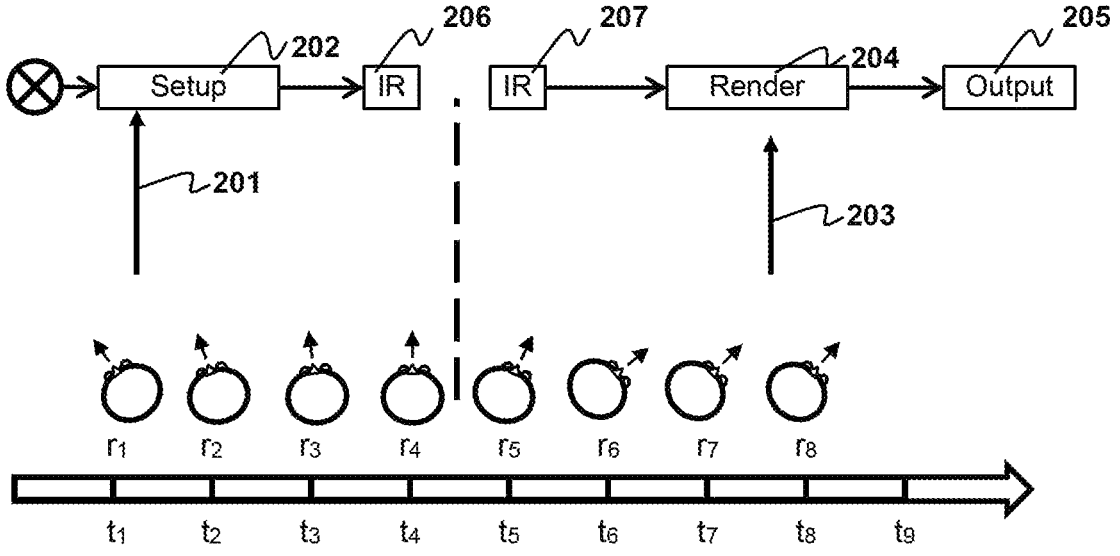
FIG. 2B is a schematic diagram illustrating another example of audio rendering according to aspects of the present disclosure.

In contrast to prior art methods of modifying audio to account for user orientation and/or position, the methods described herein manipulate the audio signals much later in the audio pipeline as shown in FIGS. 2A and 2B.

The system may take an initial reading of the user's orientation $r_1$, as indicated at 201. This initial orientation reading may be used as the reference orientation. Alternatively, the reference orientation may be a default orientation for the user, for example and with limitation, facing towards a screen. The $r_1$ reading may be taken by a user device that is part of a client system when setting up sound object at time $t_1$. The user device includes a headset with one or more speakers and a motion tracker or controller. In some implementations, the user device may also include its own microprocessor or microcontroller. As shown, there is a substantial delay between the time the audio object is set up $t_1$ and the time the audio object is output to the user $t_9$ at the user device. During this substantial delay, the user's orientation has changed from $r_1$ to $r_9$. This change in orientation means that the initial orientation reading is now incorrect. To mitigate this issue, a second orientation reading 203 is taken by the user device at $t_8$, e.g., during rendering of audio objects at 204. A transform is then applied to the rendered audio objects, e.g., to rotate them to the correct orientation $r_8$ for the user. The rotated rendered audio objects are then output to the user. For example, the rendered audio objects are reproduced through speakers after rendering. FIG. 2B is similar to 2A but after set up at 202 the audio objects may be converted to an intermediate representation (IR) or intermediate format 206. The intermediate representation is transmitted to or otherwise received by the user device 207 and the rendered locally at the user device 204. The intermediate representation received at the user device may be oriented in towards the reference position. The intermediate representation may be, for example without limitation, ambisonic format, virtual speaker format etc.

Figure 3:
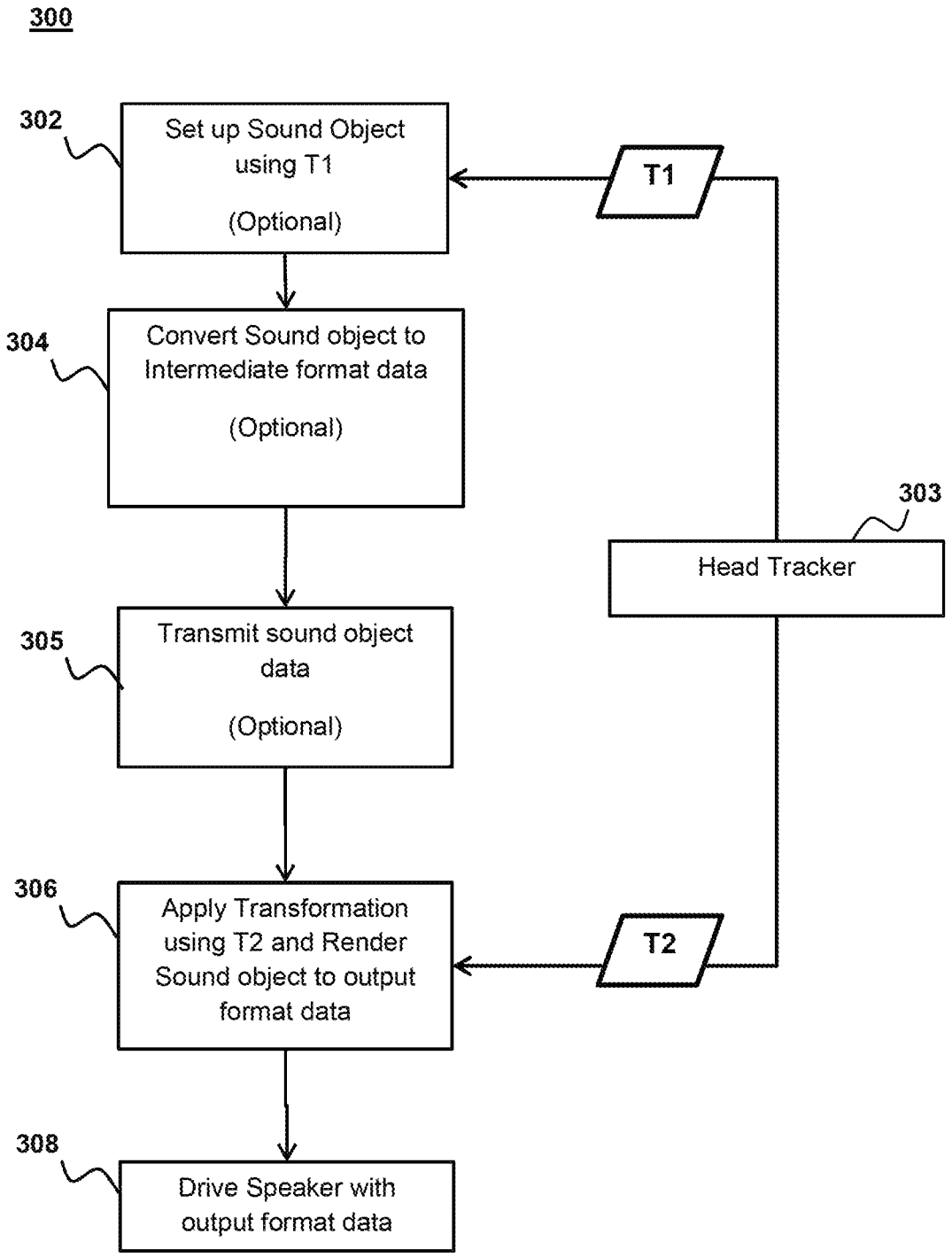
FIG. 3 is a flow diagram illustrating a method of audio rendering according to aspects of the present disclosure.

FIG. 3 shows a block diagram of the deferred audio rendering system according to aspects of the present disclosure. Initially a client device or host device may receive a user orientation t1 from a head tracker on the user device 304 while setting up audio objects 302. Some implementations may forego using a user orientation to set up audio object 302 and instead simply set up the audio objects according to a default reference direction. Yet other implementations may forego setting up objects altogether. The host device may be a remote device coupled to a user device over the network. In which case the user device sends the user orientation data through the network to the host device where it received. The remote device may be a remote client device, remote server, cloud computer server or similar without limitation. The client device may be for example a computer or game console that is local to the user and that generates the audio object information and receives the orientation data from the user device. In some implementations, the audio objects are generated by a remote host device and delivered to a client device, which relays the audio objects to the user device. In some implementations, the audio objects may be converted to an intermediate representation (IR) 304. Alternatively, the audio objects may be delivered to the user-device without modification.

The audio objects, either in intermediate representation form or as unmodified objects, may be transmitted to the user device 305. The transmission 305 may take place over the network if the device generating the audio objects is a remote host device or transmission may be through a local connection such as a wireless connection (e.g. Bluetooth, etc.) or wired connection (e.g. Universal Serial Bus (USB), FireWire, High Definition Multimedia Interface, etc.). In some implementation, the transmission is received by a client device over the network and then sent to the user device through a local connection. As discussed above the intermediate representation may be in the form of a spatial audio format such as virtual speakers, ambisonics, etc. A drawback of this approach is that in implementations where the headset comprises a pair of binaural speakers, more bandwidth is required to send the intermediate representations or the sound objects than simply sending the signal required to drive the speakers. In other headsets and sound systems, having four or more speakers the difference in bandwidth required for the intermediate representation compared to driver signals is negligible. Additionally despite the increased bandwidth requirement, the current disclosure presents the major benefit of having reduced latency.

Once the audio objects or intermediate representation is received at the user device, they are transformed according to the user's orientation 306. The user device 303 may generate head tracking data and use that data for the transformation of the audio. In some implementations both the rotation and horizontal location of the listener is included in the orientation. Manipulation of horizontal location may be done through the application of a scalar gain value as discussed above. In some implementations, a change in the horizontal location may be simulated by a simple increase or decrease in amplitude of signals for audio objects based on location. For example and without limitation if the user moves left, the amplitude of audio objects to the left of the user will be increased and in some cases the amplitude of audio objects right of the user will be decreased. Further enhancements to translational audio may include adding a Doppler effect to audio objects if they are moving away or towards the user.

In some implementations, transformations applied to the audio objects or intermediate representation is based on a change in orientation from the first orientation measurement $t_1$ by the head tracker 303 and a second orientation measurement $t_2$. In some implementations, the transformations applied are in relation to reference position such as facing a TV screen or camera and in which case the orientation transformation may be an absolute orientation measurement with relation to the reference point. In both of these implementations, it is important to note that whatever transformation is applied to the audio objects or intermediate representations, the transformation must be suitable for the format of the object or intermediate representation. For example and without limitation, ambisonic transformations must be applied to an ambisonic intermediate representation and if a transformation is applied earlier in the audio pipeline 302, the later transformation 306 must be in a similar format.

Alternative implementations, which use a controller and/or camera for motion detection, may apply transformations based on a predicted orientation. These transformations using predicted orientation may be applied before the user device 302 receives the audio and/or after the user device 306 receives the audio. The predicted orientation may be generated based on for example and without limitation a controller position.

After a transformation is applied, the audio object or intermediate representation is rendered into an output format. The output format may be analog audio signals, digital reproductions of analog audio signals, or any other format that can be used to drive a speaker and reproduce the desired audio.

Finally, the audio in the output format is provided to the headphones and/or standalone speakers and used to output format is used to drive the speakers to reproduce the audio in the correct orientation for the user 308.

System

Figure 4:
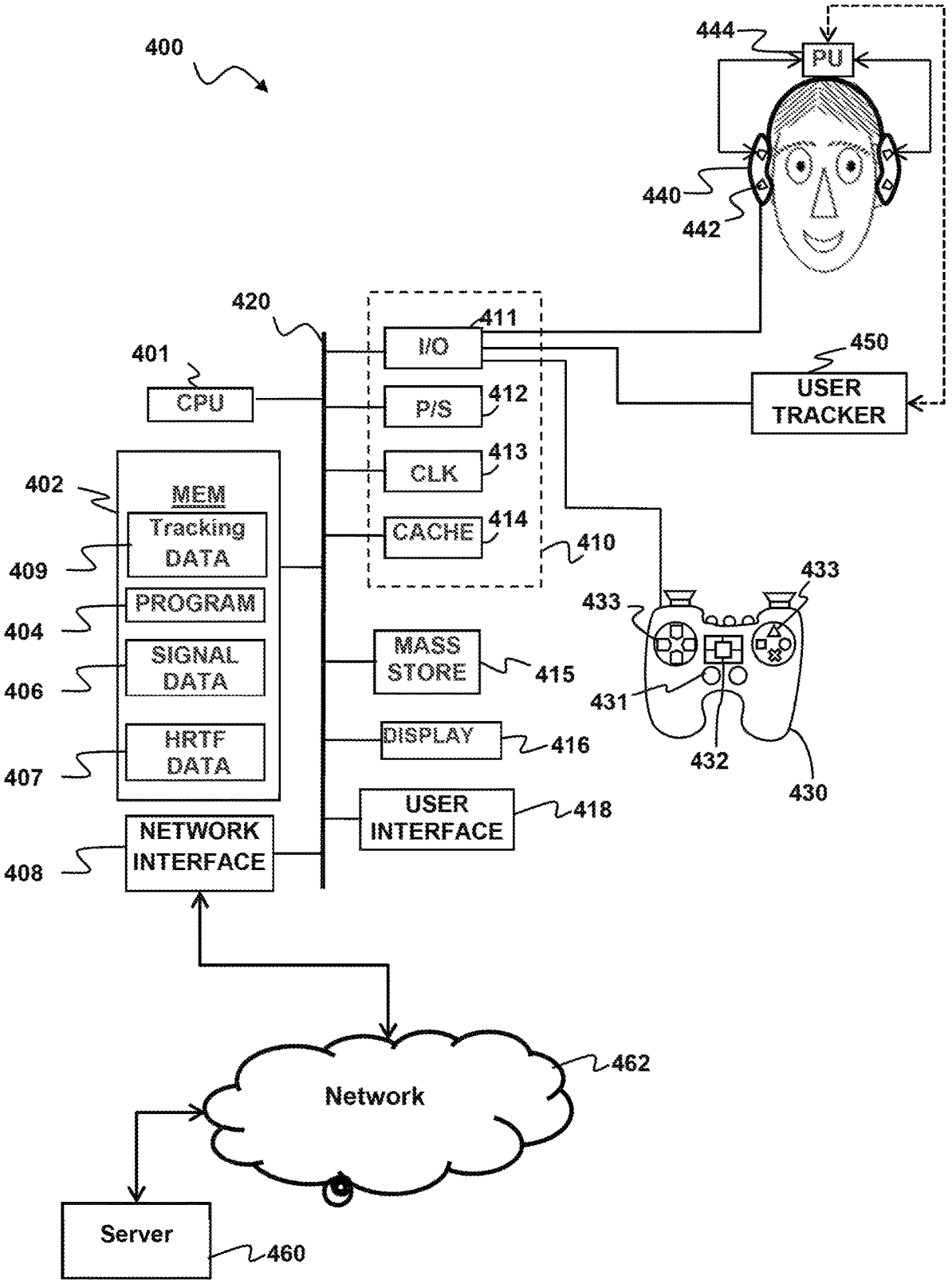
FIG. 4 is a schematic diagram depicting an audio rendering system according to aspects of the present disclosure.

Turning to FIG. 4, a block diagram of an example system 400 having a user device configured to localize sounds in signals received from a remote server 460 in accordance with aspects of the present disclosure.

The example system 400 may include computing components which are coupled to a sound system 440 in order to process and/or output audio signals in accordance with aspects of the present disclosure. By way of example, and not by way of limitation, in some implementations the sound system 440 may be a set of stereo or surround headphones, some or all of the computing components may be part of a headphone system 440 Furthermore, in some implementations, the system 400 may be part of a head mounted display, headset, embedded system, mobile phone, personal computer, tablet computer, portable game device, workstation, game console, set-top box, stand-alone amplifier unit and the like.

The example system may additionally be coupled to a game controller 430. The game controller may have numerous features which aid in tracking its location and which may be used to assist in the optimization of sound. A microphone array may be coupled to the controller for enhanced location detection. The game controller may also have numerous light sources that may be detected by an image capture unit and the location of the controller within the room may be detected from the location of the light sources. Other location detection systems may be coupled to the game controller 430, including accelerometers and/or gyroscopic displacement sensors to detect movement of the controller within the room. According to aspects of the present disclosure the game controller 430 may also have user input controls such as a direction pad and buttons 433, joysticks 431, and/or Touchpads 432. The game controller may also be mountable to the user's body.

The system 400 may be configured to process audio signals to de-convolve and convolve impulse responses and/or generate spherical harmonic signals in accordance with aspects of the present disclosure. The system 400 may include one or more processor units 401, which may be configured according to well-known architectures, such as, e.g., single-core, dual-core, quad-core, multi-core, processor-coprocessor, accelerated processing unit and the like. The system 400 may also include one or more memory units 402 (e.g., RAM, DRAM, ROM, and the like).

The processor unit 401 may execute one or more programs 404, portions of which may be stored in the memory 402, and the processor 401 may be operatively coupled to the memory 402, e.g., by accessing the memory via a data bus 420. The programs may be configured to process source audio signals 406, e.g. for converting the signals to localized signals for later use or output to the headphones 440. Each headphone may include one or more speakers 442, which may be arranged in a surround sound or other high-definition audio configuration. The programs may configure the processing unit 401 to generate tracking data 409 representing the location of the user. The system in some implementations generates spherical harmonics of the signal data 406 using the tracking data 409. Alternatively the memory 402 may have HRTF Data 407 for convolution with the signal data 406 and which may be selected based on the tracking data 409. By way of example, and not by way of limitation, the memory 402 may include programs 404, execution of which may cause the system 400 to perform a method having one or more features in common with the example methods above, such as method 300 of FIG. 3 By way of example, and not by way of limitation, the programs 404 may include processor executable instructions which cause the system 400 to implement deferred audio rendering as described hereinabove by applying an orientation transform in conjunction with rendering sound objects. In some implementations, the headphones 440 may be part of a headset that includes a processor unit 444 coupled to the speakers 442 so that the orientation transformation can be applied locally.

The system 400 may include a user tracking device 450 configured to track the user's location and/or orientation. There are a number of possible configurations for the tracking device. For example, in some configurations the tracking device 450 may include an image capture device such as a video camera or other optical tracking device. In other implementations, the tracking device 450 may include one or more inertial sensors, e.g., accelerometers and/or gyroscopic sensors that the user wears. By way of example, such inertial sensors may be included in the same headset that includes the headphones 440. In implementations where the headset includes a local processor 444 the tracking device 450 and local processor may be configured to communicate directly with each other, e.g., over a wired, wireless, infrared, or other communication link.

The system 400 may also include well-known support circuits 410, such as input/output (I/O) circuits 411, power supplies (P/S) 412, a clock (CLK) 413, and cache 414, which may communicate with other components of the system, e.g., via the bus 420. The system 400 may also include a mass storage device 415 such as a disk drive, CD-ROM drive, tape drive, flash memory, or the like, and the mass storage device 415 may store programs and/or data. The system 400 may also include a user interface 418 and a display 416 to facilitate interaction between the system 400 and a user. The user interface 418 may include a keyboard, mouse, light pen, touch interface, or other device. The system 400 may also execute one or more general computer applications (not pictured), such as a video game, which may incorporate aspects of surround sound as computed by the sound localizing programs 404.

The system 400 may include a network interface 408, configured to enable the use of Wi-Fi, an Ethernet port, or other communication methods. The network interface 408 may incorporate suitable hardware, software, firmware or some combination thereof to facilitate communication via a telecommunications network 462. The network interface 408 may be configured to implement wired or wireless communication over local area networks and wide area networks such as the Internet. The system 400 may send and receive data and/or requests for files via one or more data packets over a network.

It will readily be appreciated that many variations on the components depicted in FIG. 4 are possible, and that various ones of these components may be implemented in hardware, software, firmware, or some combination thereof. For example, some features or all features of the convolution programs contained in the memory 402 and executed by the processor 401 may be implemented via suitably configured hardware, such as one or more application specific integrated circuits (ASIC) or a field programmable gate array (FPGA) configured to perform some or all aspects of example processing techniques described herein. It should be understood that non-transitory computer readable media refers herein to all forms of storage which may be used to contain the programs and data including memory 402, Mass storage devices 415 and built in logic such as firmware.

Figure 5A:
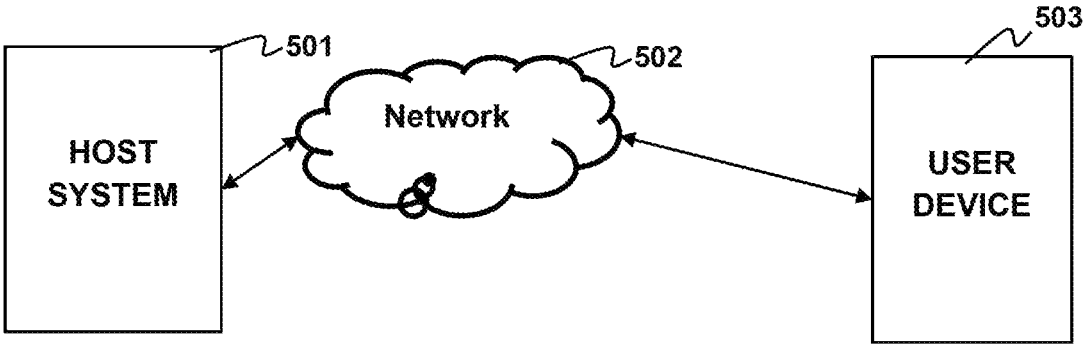
FIG. 5A is a schematic diagram of a connected systems configuration having a user device coupled to a host system according to aspects of the present disclosure.
Figure 5B:
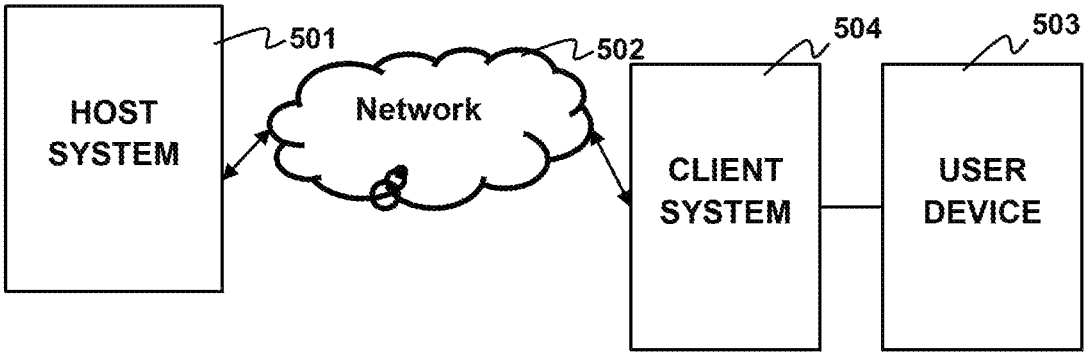
FIG. 5B is a schematic diagram of a connected systems configuration having a user device coupled through a client device to a host system according to aspects of the present disclosure.
Figure 5C:
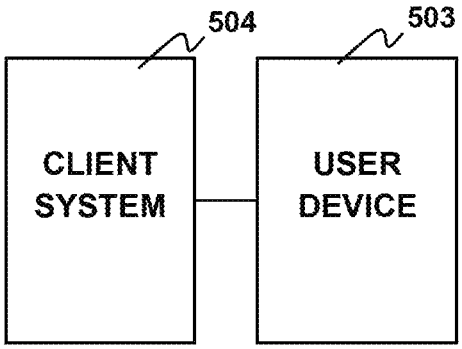
FIG. 5C is a schematic diagram of a connected systems configuration having a user device coupled to a client device according to aspects of the present disclosure

FIGS. 5A, 5B and 5C depict examples of connected systems configurations according to aspects of the present disclosure. As shown in FIG. 5A, a host system 501 may deliver audio information (without limitation audio objects, IR, etc.) to the user device 503 over a network 502. The host system may be a server as depicted in the system 400 of FIG. 4, may be a cloud-computing network, remote computer or other type device suitable to deliver audio over a network. The user device may be computing system 400. The user device 503 may be in communication with the host system 501 and deliver information such as orientation data, microphone data, button presses, etc. to the host system 501.

As shown in FIG. 5B a client device 504 may be situated between the host system 501 and the user device 503. The client device 504 may receive audio information along with other information such as video data or game data over the network 502. The client device 504 may relay the audio information to the user device 503. In other implementations the client device 504 may modify the audio information before delivery to the user device 503 such as by adding after effects or adding initial orientation transformations to the audio, etc. The user device 503 may be in communication with the client device and deliver information such as orientation data, microphone data, button presses, etc. to the client device 504. The client device 504 may relay information received from the user device 503 to the host system 501 through the network 502.

FIG. 5C shows an implementation having the user device 503 coupled to the client device 504 without a network connection. Here, the client device 504 generates the audio information and delivers it to the user device 503. The user device 503 may be in communication with the client device 504 and deliver information such as orientation data, microphone data, button presses, etc. to the client device 504.

CONCLUSION

While the above is a complete description of the preferred embodiment of the present invention, it is possible to use various alternatives, modifications and equivalents. Therefore, the scope of the present invention should be determined not with reference to the above description but should, instead, be determined with reference to the appended claims, along with their full scope of equivalents. Any feature described herein, whether preferred or not, may be combined with any other feature described herein, whether preferred or not. In the claims that follow, the indefinite article "a", or "an" refers to a quantity of one or more of the item following the article, except where expressly stated otherwise. The appended claims are not to be interpreted as including means-plus-function limitations, unless such a limitation is explicitly recited in a given claim using the phrase "means for."

What is claimed is:

1. An audio rendering method, comprising:

obtaining sound object data for a sound object having a first orientation, wherein the first orientation is dependent upon initial user tracking information and wherein the sound object data is in a first format suitable for rendering into an output signal, wherein the sound object data is generated using the initial user tracking information by a first device;

sending the sound object to a second device;

obtaining subsequent user tracking information for a user at a time subsequent to setting up the sound object data in the first format;

rendering the sound object using the second device by converting the sound object data from the first format into the output signal and in conjunction with said rendering applying a transform to the sound object to have a second orientation, wherein the transform depends on the subsequent user tracking data; and driving two or more speakers using the output signal.

2. The method of claim 1, wherein the transform includes a rotation transform.

3. The method of claim 1, wherein the transform includes a translation transform.

4. The method of claim 1, wherein rendering the sound object by converting the sound object data from the first format into the output signal and in conjunction with said rendering applying a transform to the sound object includes applying the transform to the sound object data in the first format and then converting the sound object data from the first format into the output format to generate the output data.

5. The method of claim 1, wherein the first format is a spatial audio format.

6. The method of claim 5, wherein the spatial audio format is an ambisonics format.

7. The method of claim 5, wherein the spatial audio format is a spherical harmonics format.

8. The method of claim 5, wherein the spatial audio format is a virtual speaker format.

9. The method of claim 1, wherein the first format is an intermediate format and wherein said obtaining sound object data includes converting sound object data in a spatial audio format to an intermediate format.

10. The method of claim 1, wherein the first format is an intermediate format, wherein said obtaining sound object data includes converting sound object data in a spatial audio format to an intermediate format, and wherein said rendering the sound object includes converting the sound object data from the intermediate format to the spatial audio format.

11. The method of claim 1, wherein the first format is an intermediate format, wherein said obtaining sound object data includes converting sound object data in a first spatial audio format to an intermediate format, and wherein said rendering the sound object includes converting the sound object data from the intermediate format to a second spatial audio format that is different from the first spatial audio format.

12. The method of claim 1, wherein said obtaining sound object data includes receiving the sound object data via a network from a remote server.

13. The method of claim 1, wherein the output signal is a binaural stereo signal.

14. The method of claim 1, wherein the initial or subsequent tracking information is obtained from a tracking device that measures a location and/or orientation of a user's head.

15. The method of claim 1, wherein the initial or subsequent tracking information is obtained by predicting a location and/or orientation of a user's head from information obtained by a controller the user is using.

16. The method of claim 1, wherein the two or more speakers are part of a set of headphones, and wherein the initial or subsequent tracking information is obtained from a tracking device that measures a location and/or orientation of a head of a user wearing the headphones.

17. An audio rendering system, comprising:

a processor;

a memory coupled to the processor, the memory having executable instructions embodied therein, the instructions being configured to cause the processor to carry out an audio rendering method when executed, the audio rendering method comprising:

obtaining sound object data for a sound object having a first orientation, wherein the first orientation is dependent upon the initial user tracking information and wherein the sound object data is in a first format suitable for rendering into an output signal, wherein the sound object data is generated using the initial user tracking information by a first device;

sending the sound object to a second device;

obtaining subsequent user tracking information for a user at a time subsequent to setting up the sound object data in the first format;

rendering the sound object using the second device by converting the sound object data from the first format into the output signal and in conjunction with said rendering applying a transform to the sound object to have a second orientation, wherein the transform depends on the subsequent user tracking data; and driving a speaker using the output data.

18. The system of claim 17, further comprising a headset, wherein the two or more speakers are part of the headset, and wherein the initial or subsequent tracking information is obtained from a tracking device that measures a location and/or orientation of a head of a user wearing the headset.

19. The system of claim 17, further comprising a headset, wherein the two or more speakers are part of the headset, the system further comprising a tracking device that measures a location and/or orientation of a head of a user wearing the headset, wherein the initial or subsequent tracking information is obtained from the tracking device.

20. The system of claim 17, further comprising a headset, wherein the two or more speakers are part of the headset, the headset further including a local processor connected to the two or more speakers configured to apply the transformation to the sound object.

21. The system of claim 17, further comprising a headset, wherein the two or more speakers are part of the headset, the headset further including a tracking device that measures a location and/or orientation of a head of a user wearing the headset, wherein the initial or subsequent tracking information is obtained from the tracking device, the headset further including a local processor connected to the two or more speakers and the tracking device configured to apply the transformation to the sound object.

22. A non-transitory computer readable medium with executable instructions embodied therein wherein execution of the instructions cause a processor to carry out an audio rendering method comprising:

obtaining sound object data for the sound object having the first orientation, wherein the first orientation is dependent upon initial user tracking information and wherein the sound object data is in a first format suitable for rendering into an output signal, wherein the sound object data is generated using the initial user tracking information by a first device;

sending the sound object to a second device;

obtaining subsequent user tracking information for a user at a time subsequent to setting up the sound object data in the first format;

rendering the sound object using the second device by converting the sound object data from the first format into the output signal and in conjunction with said rendering applying a transform to the sound object to have a second orientation, wherein the transform depends on the subsequent user tracking data; and driving a speaker using the output data.

* * * * *